United States Patent [19]

Svetlov et al.

[11] 4,208,040

[45] Jun. 17, 1980

[54] APPARATUS FOR THE GAS CARBURIZING OF THE BORE IN AN OBJECT

[76] Inventors: Sergei A. Svetlov, prospekt imeni V.I.Lenina, 28, kv. 29; Valentin S. Mokin, prospekt imeni V.I.Lenina, 28, kv. 101; Mark S. Shneiderman, ulitsa Vorovskogo,45, kv. 19; Mikhail G. Selnitsyn, ulitsa Vorovskogo,17-v, kv. 8; Vladimir A. Lupin, ulitsa Gagarina,34-a, kv. 69; Timofei I. Penyaskin, ulitsa Pushkina,56, kv. 107; Gennady P. Stepanov, ulitsa Engelsa,45, kv. 55; Ivan Y. Reger, ulitsa Zykina,55; Nikolai I. Timkin, ulitsa Svobody,155-a, kv. 62, all of Chelyabinsk, U.S.S.R.

[21] Appl. No.: 921,051

[22] Filed: Jun. 30, 1978

[51] Int. Cl.[2] ..... C23C 9/06

[52] U.S. Cl. ..... 266/121; 266/127; 266/129; 266/274

[58] Field of Search ..... 266/121, 127, 129, 252, 266/258, 274

[56] References Cited

U.S. PATENT DOCUMENTS

| | | | |
|---|---|---|---|
| Re. 22,064 | 4/1942 | Somes | 266/127 |
| 2,318,145 | 5/1943 | Emery et al. | 266/121 |
| 2,930,603 | 3/1960 | Voss et al. | 266/258 |
| 3,326,542 | 6/1967 | Mescher et al. | 266/252 |
| 3,507,712 | 4/1970 | Scott | 266/121 |

*Primary Examiner*—L. Dewayne Rutledge
*Assistant Examiner*—John P. Sheehan
*Attorney, Agent, or Firm*—Lackenbach, Lilling & Siegel

[57] ABSTRACT

The apparatus is provided with a manifold-type means of feeding gas into the bore of the treated object and a means of discharging gas from the bore of this object which are secured as cantilevers to brackets of a frame. These means are provided with drives enabling them to displace longitudinally so as to assure the clamping of the treated object therebetween at the end faces. The apparatus is also provided with a drive causing the treated object to rotate integrally with said means. Contrivances serving to heat up and subsequently to cool down the treated object are mounted on a platform which is installed on horizontal guides and is provided with a drive for longitudinal travel.

3 Claims, 5 Drawing Figures

APPARATUS FOR THE GAS CARBURIZING OF THE BORE IN AN OBJECT

BACKGROUND OF THE INVENTION

The present invention relates to apparatus for gas carburizing the bore in objects used in mechanical engineering and metallurgy. It may be implemented with utmost effectiveness in strengthening the bore of pipes handling abrasive materials, e.g., pulp, or used for the pneumatic conveying of bulk materials.

Disclosed in USSR Inventor's Certificate No. 492,569 is an apparatus for the thermal strengthening of pipes consisting of a heating device and a sprayer for cooling which are both accommodated in a common nozzle along with concentrically arranged tubes for feeding a gas-air mixture and water. Designed for hardening the bore of pipes, this apparatus is of comparatively simple construction, its main elements being a heater in the form of a gas burner and a sprayer. Yet, this apparatus is unsuitable for the treatment of bores by the gas carburizing technique since it lacks means of sealing off the bore of the treated object at the end faces. Moreover, the known apparatus is not provided with a system for the automatic feeding of carburizing gas into said bore of the treated object.

Also known is an apparatus for the electric resistance heating of hollow objects disclosed in USSR Inventor's Certificate No. 283,269 comprising contact clamps applied to the end of the object, an evacuation system with a sealing arrangement in the form of cones displaced by means of a drive, and hollow mandrels connected to the evacuation system. Designed to produce a bright finish of the pipe bore in the course of resistance annealing of pipes, this apparatus incorporates, as indicated above, sealing cones with a drive imparting motion thereto, current-feeding contact clamps and hollow mandrels connected to the evacuation system so as to evacuate air from the bore of the treated pipe. However, as far as gas carburizing of bores is concerned, this apparatus is of no avail because uniform heating of the pipe walls is hardly achievable with the resistance heating technique and, as a consequence, the process of carburizing goes on at a rate which is anything but uniform. The carburized case so formed is of varying depth, impairing the quality of the product. Another point is that the lack of a support along the length of the pipe brings about residual deformation manifesting itself in the bending of pipes.

With the hydraulic and pneumatic conveying of abrasive materials by pipelines coming into vogue, there is an everincreasing demand for pipes with high-strength bores. All the known apparatus fail to meet this demand and, as a result, difficulties are experienced in operating pipelines for the pneumatic or hydraulic conveying of pulp and other abrasive materials.

SUMMARY OF THE INVENTION

It is the main object of the present invention to provide an apparatus for gas carburizing the bore in an object which will improve the quality of the surface treated, assuring the formation of a carburized case of uniform depth at any point of the bore.

Another object of the present invention, which is regarded as being of equal importance as the above one, is to automate the feeding of carburizing gas into the sealed bore of the treated object during the course of its rotation.

A further important object of the present invention is to eliminate the bending of long objects during the course of their treatment.

An important object of the invention is also to extend the service life of the means for feeding gas into the pipe bore.

These and other objects are attained by providing an apparatus for the gas carburizing of the bore in an object incorporating a means for feeding gas into the bore of the treated object and a means for discharging gas from the bore of this object. Said are secured as cantilevers to corresponding brackets of a frame and are provided with drives causing them to displace longitudinally to clamp the treated object at the opposite end faces, said apparatus also incorporates a drive causing the treated object to rotate integrally with the means for feeding gas into the bore as well as with the means for discharging gas from the bore of the treated object and incorporating a manifold which communicates with a gas line of the means for feeding gas into the bore of the treated object whereas contrivances for heating and cooling are mounted on a platform which is provided with a drive for longitudinal travel and is installed on horizontal guides.

An apparatus designed as above wherein the means for feeding gas into the bore of the treated object and the means of discharging gas from the bore of this object are provided with a rotary drive and a manifold communicating with a gas line of the first of said means and operate in conjunction with contrivances for heating and cooling which are installed on a platform is instrumental in improving the quality of bore treatment, since a carburizing case of uniform depth is obtained, and the feeding of gas into the bore of the rotating object is a completely automatic operation.

It is expedient that the means for feeding and discharging gas are provided with spaces for a coolant to pass therethrough and to accommodate gas lines therein. This will extend the service life of the means for feeding gas into the bore of the treated object and the means for discharging gas therefrom.

It is also expedient to accommodate rollers on the table to support the treated object. This will prevent the bending of the treated object during its heating and eliminate residual deformation.

An apparatus of the disclosed design assures automatic feeding of gas into the sealed off bore of the treated object while this object is being rotated. In addition, such apparatus provides an answer to the problem of extending service life of the pipes used for conveying abrasive materials in either liquid or gaseous medium in huge amounts under the conditions of high velocities. An extension of the service life of pipelines is conducive to savings in the cost of conveying abrasive materials.

DESCRIPTION OF THE DRAWINGS

The present invention will be best understood from the following description of an apparatus in accordance with the invention when this description is being read in conjunction with the accompanying drawings in which.

DETAILED DESCRIPTION OF THE INVENTION

Figure 1:
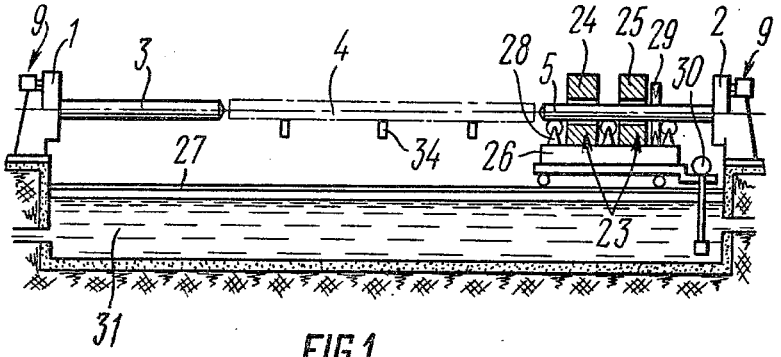
FIG. 1 is a side elevation of the apparatus in its initial position.
Figure 2:
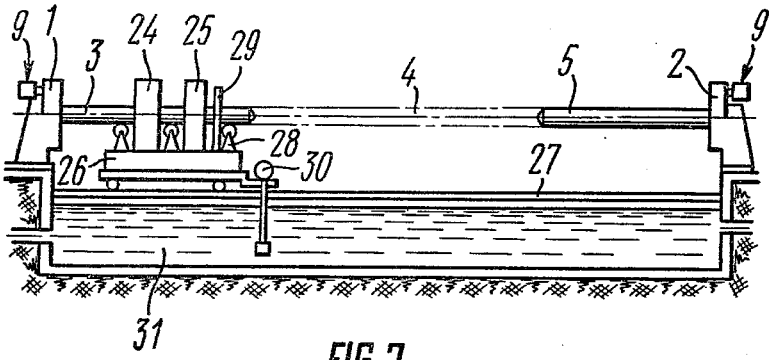
FIG. 2 is a view similar to FIG. 1, illustrating the apparatus in a position following the treatment of an object.
Figure 3:
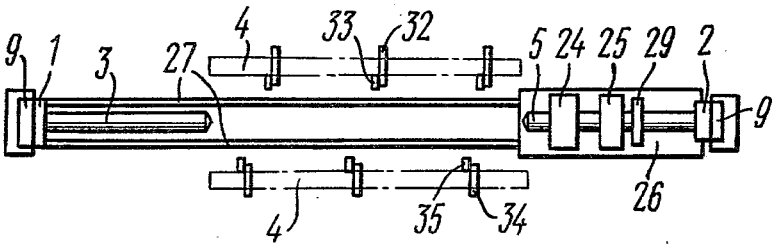
FIG. 3 is a plan view of FIG. 1.
Figure 4:
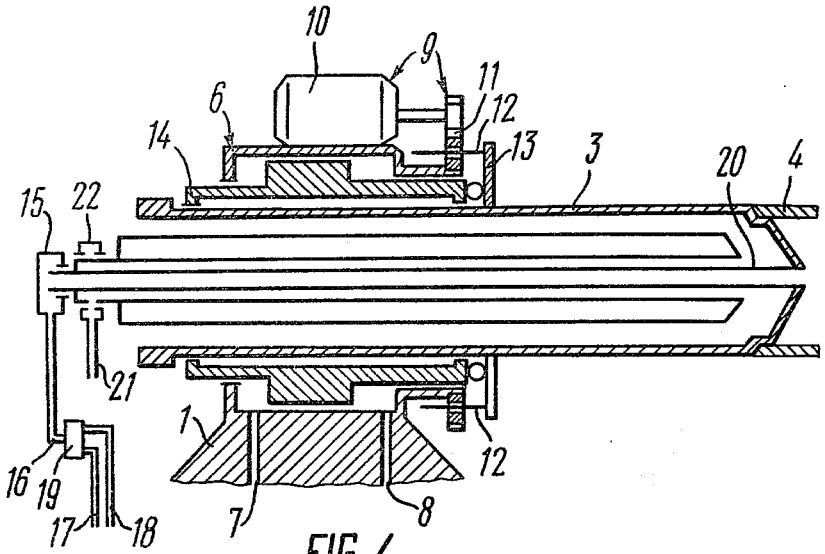
FIG. 4 is a sectional elevation of the means of feeding gas into the bore of the treated object with the mechanism imparting rotary motion thereto.

The apparatus for the gas carburizing the bore in an object is installed on a frame with brackets 1 and 2 (FIGS. 1, 2 and 3). Attached to the bracket 1 is a cantilevered means 3 for feeding gas into the bore of a treated object 4 shown by dot-and-dash lines. A cantilevered means 5 of discharging gas from the bore of the treated object 4 is arranged coaxially with the means 3 for feeding gas and is attached to the bracket 2. Each of said means 3 and 5 is provided with a drive 6 (FIG. 4) enabling them to move longitudinally, said drive being, for example, an air cylinder the bores whereof are connected to air passages 7 and 8 provided in the bracket 1. Both drives 6 are of identical construction, functioning so as to clear space for the object 4 by moving the means 3 and 5 in the outward direction and then clamping said object 4 between the means 3 and 5 by displacing them inwardly until they come abutting against the end faces of the object.

A rotary drive 9 causing the treated object 4 to rotate integrally with the means 3 of feeding gas into the treated object 4 and the means 5 of discharging the spent gas from the bore of this object, said means being linked up with said object at its end faces, is fitted to either of the brackets 1 and 2 or to both of them simultaneously. The rotary drive 9 is a d-c motor 10 (FIG. 4) coupled to the means 3 of feeding gas through the intermediary of gears 11, drive pins 12 and thrust flanges 13. The means 5 of discharging gas (FIG. 1) receives the drive in the same way. The means 3 and 5 are located inside corresponding piston rods 14 of the drives 6 (FIG. 4) including longitudinal displacement.

The means 3 of feeding gas is provided with a manifold 15 communicating with pipes 16, 17, 18 and a slide valve 19 which provide for the automatic initiating and stopping of the gas flow, and a gas line 20.

The means 3 of feeding gas and the means 5 for discharging waste gas can be provided with cooling arrangements.

To this end admitted through pipelines 21 communicating through manifolds 22 with the spaces of the means 3 and 5 being cooled is a coolant (water), whereas mounted coaxially in the spaces being cooled are gas lines 20.

The apparatus disclosed is provided with a contrivance 23 (FIG. 1) for heating up the treated object comprising an induction oven 24 and an induction oven 25 controlled by a thermostat, or just an induction oven, mounted on a platform 26 which is fitted with a drive (not shown) causing it to displace longitudinally and is installed on horizontal guides 27. Available on the platform 26 are rollers 28 which serve to support the heated object 4 and prevent it from bending.

For the subsequent cooling of the object 4, there is provided a contrivance 29 which is a ring-shaped sprayer connected to a pump 30 which feeds a coolant contained in a tank 31.

For the transverse displacement of the treated object 4, the apparatus is provided with a feeder 32 in the form of a roller table or an inclined rack with a leverage 33 as well as with a take-away arrangement 34 and another leverage 35.

The apparatus incorporates a number of electrical and mechanical interlocking devices for starting and stopping the existing drives. These devices are all of known design and therefore their description is omitted.

Figure 5:
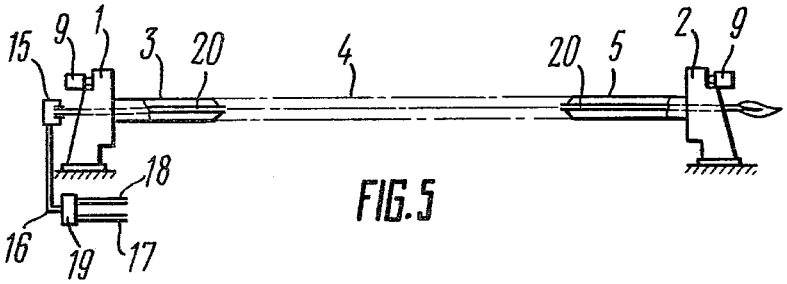
FIG. 5 is a schematic drawing illustrating the way carburizing gas is being fed into the bore of the treated object and discharged therefrom.

The apparatus operates in the following way. An object 4 to be treated (FIG. 1), for example, a pipe, is removed from the feeder 32 (FIG. 3) and placed by means of the leverage 33 into a position wherein it is coaxial with the means 3 and 5 (FIG. 1). Next, compressed air is admitted over the passage 7 into the cylinder of the drive 6 which causes the means 3 to move toward the means 5 actuated by another drive 6 with the result that the object 4 (pipe) is clamped at its end faces between the means 3 and 5. The tapered end faces of the means 3 and 5 (FIG. 1) which become linked up with the object 4 are given a shape assuring tightness of the bore in the object 4. As soon as the leverage 33 returns into its initial position (FIG. 3), carburizing gas automatically starts flowing over a system of pipes 17 and 18 (FIGS. 4 and 5) with the slide valve 19, reaching the bore of the object 4 via the pipe 16, the manifold 15 and the gas line 20 inside the means 3 for feeding gas. Once the bore is filled with carburizing gas, the drives 9 (FIG. 1) imparting rotary motion to the means 3 and 5 integrally with the treated object 4 are automatically set into operation, and, simultaneously, a coolant serving to cool the means 3 is admitted into the water manifold 22 (FIG. 4) from the pipe 21. The means 5 is cooled by a similar arrangement. The water contained in the tank 31 (FIG. 1 and 2) is fed by the pump 30 into the induction ovens 24 and 25 to cool them and also is fed into the sprayer 29. Then the drive for longitudinal displacement of the platform 26 is automatically energized as well as the means 23 for heating the treated object 4. The platform 26 is set into motion along the treated object 4 so that it is heated by the induction ovens 24 and 25 in succession and then cooled by the sprayer 29. When the platform 26 arrives into the position illustrated in FIG. 2, the drive of the platform 26 is automatically cut off and so is the supply to the induction heaters 24, 25 and to the drives 9 rotating the means 3 and 5. After that, the bore of the object 4 is blown through with an inert gas admitted thereinto with the aid of the slide valve 19 (FIG. 4) and then, when the blowing is finished, the leverage 35 (FIG. 3) is automatically set into operation. Simultaneously, compressed air is admitted into the passage 8 (FIG. 4) of the drive 6, causing the means 3 to displace longitudinally. The means 5 is being displaced in the same way with the result that both said means, moving in opposite directions, release the object 4 which is transferred on the take-way arrangement 34 (FIG. 3) in the form of, for example, a rack or a rolling table. The leverage 35, on transferring the object 4 to the take-away arrangement 34, returns into its initial position. At the same time, the longitudinal drive of the platform 26 is set to operate in reverse, returning said table into its original position indicated in FIG. 1. After that, in the end of the travel the drive is automatically stopped and so is the pump 30 feeding coolant into the means 3 and 5. This completes the cycle of treating the object (pipe), and for treating the next object the procedure is repeated exactly in the same way.

What is claimed is:

1. An apparatus for gas carburizing the bore in an object, comprising a frame with two brackets; horizontal guides secured to said frame; a platform installed on said horizontal guides provided with a drive for longitudinal displacement; a contrivance for uniformly heating the treated object, said contrivance installed on said platform; a cooling spraying contrivance installed on said platform; a means for feeding gas into the bore of the treated object, said means being attached as a cantilever to one of the brackets of said frame; a manifold for feeding gas connected to a gas line of said means of feeding gas into the bore of the treated object; a means for discharging gas from the bore of the treated object, said means being attached as a cantilever to the second bracket of said frame; a drive causing the means for feeding gas to displace longitudinally and pressing said means to an end face of the treated object, said drive being mounted on the first bracket of said frame; a drive causing the means of discharging gas to displace horizontally and pressing said means to the other end face of the treated object mounted on the second bracket of said frame; a drive causing the treated object to rotate integrally with said means of feeding gas and said means of discharging gas from the bore of the treated object.

2. An apparatus as claimed in claim 1, wherein said means of feeding gas is provided with a space for passing through a coolant, and accommodated therein is a gas line connected to said manifold.

3. An apparatus as claimed in claim 1, wherein rollers serving to support the treated object are located on said platform.

* * * * *